US007354279B2

(12) United States Patent
Uesaka

(10) Patent No.: US 7,354,279 B2
(45) Date of Patent: Apr. 8, 2008

(54) FLOATING CONNECTOR

(75) Inventor: Ryo Uesaka, Ebina (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/605,029

(22) Filed: Nov. 28, 2006

(65) Prior Publication Data

US 2007/0202729 A1 Aug. 30, 2007

(30) Foreign Application Priority Data

Nov. 28, 2005 (JP) ..... 2005-341540

(51) Int. Cl.
*H01R 12/00* (2006.01)

(52) U.S. Cl. ..... 439/74; 439/660; 439/83

(58) Field of Classification Search ..... 439/74, 439/660, 83, 284, 247, 65, 876, 70–71, 563
See application file for complete search history.

(56) References Cited

U.S. PATENT DOCUMENTS 5,259,779 A * 11/1993 Ooya et al. ..... 439/247
5,975,916 A * 11/1999 Okura ..... 439/74
7,186,126 B2 * 3/2007 Umehara et al. ..... 439/247
7,195,495 B2 * 3/2007 Takano et al. ..... 439/74
2006/0258199 A1 * 11/2006 Umehara et al. ..... 439/247

* cited by examiner

*Primary Examiner*—J. F. Duverne
(74) *Attorney, Agent, or Firm*—Thomas D. Paulius

(57) ABSTRACT

A floating connector is disclosed with an inner housing that is movably held within an outer housing. The connection between the inner and outer housing is effected by terminals with increased flexibility. Fitting nails are provided that serve as stops to limit the upward movement of the inner housing relative to the outer housing.

9 Claims, 5 Drawing Sheets

FIG.6
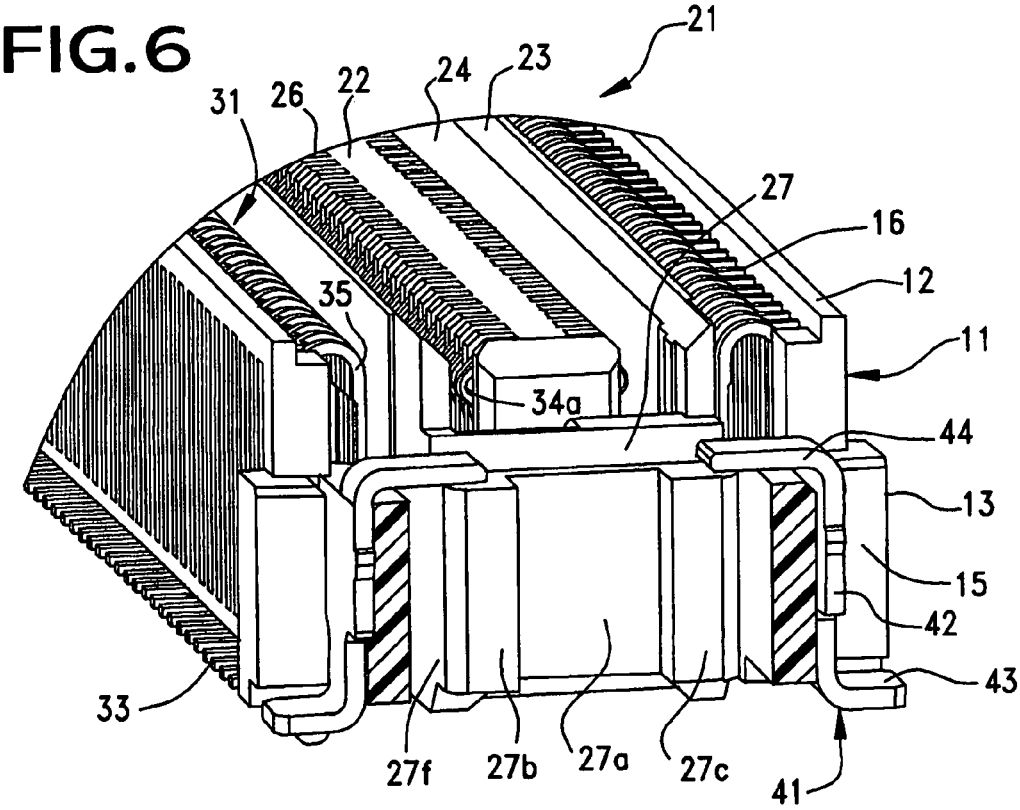
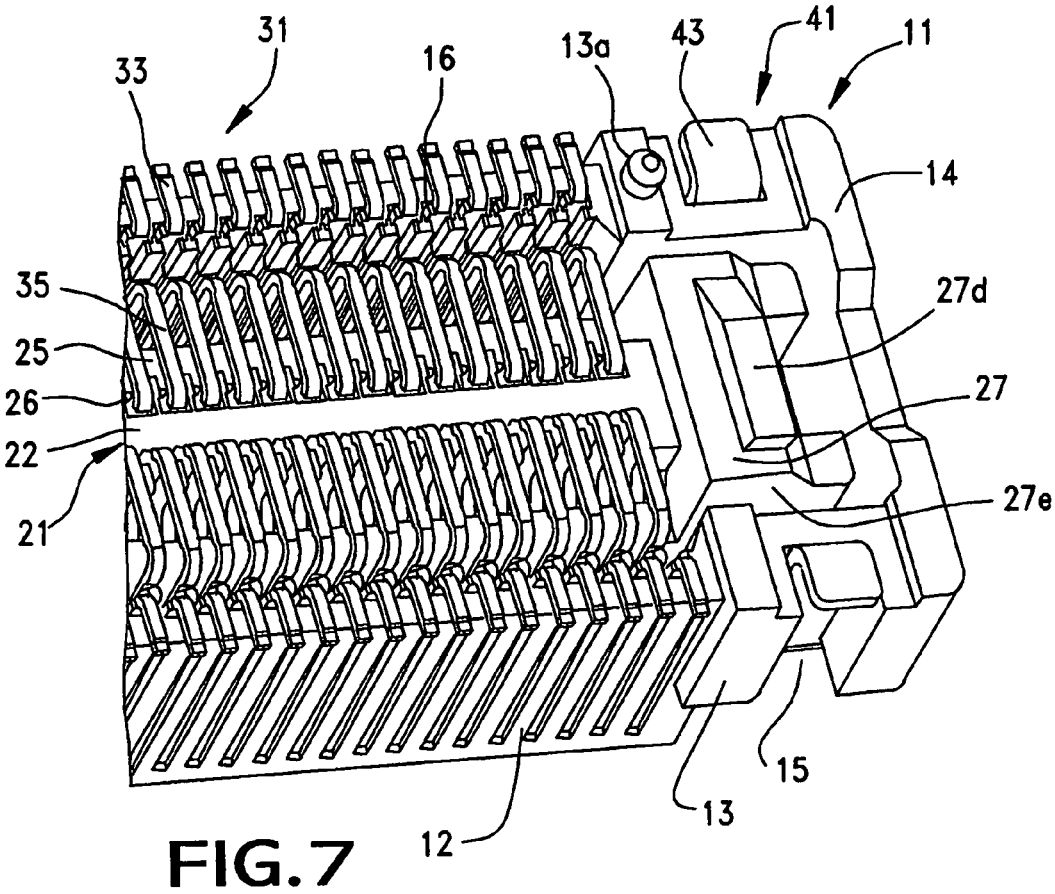
FIG.7

FLOATING CONNECTOR

BACKGROUND OF THE INVENTION

The present invention relates generally to electrical connectors, and more specifically to floating connectors having a first connector portion movably attached to a second connector portion and wherein the first connector portion is capable of movement relative to the second connector portion.

Board-to-board connectors are commonly used to electrically connect a pair of parallel circuit boards together. In some cases, the relative positions of the connected circuit boards deviate from their preset positions. In order to absorb such a positional deviation between the circuit boards, floating-style connectors have been used. Japanese Utility Model Publication (kokoku) No. 07-33408 illustrates one such type of connector.

FIG. 9 is a sectional, perspective view of a conventional floating-type connector. In FIG. 9, the connector includes an outer housing 301 that is attached to a circuit board (not shown). A recess 303 is formed in the outer housing 301, and an inner housing 302 is accommodated in the recess 303 so as to move in the X-, Y-, and Z-axis directions. A stopper frame 306 restricts the movement of the inner housing 302 in the X-axis direction, while the inner walls of the recess 303 restrict the movement of the inner housing 302 in the Y-axis direction; and stopper pieces 304 of the inner housing 302 and upper pieces 305 of the outer housing 301 restrict the movement of the inner housing 302 in the Z-axis direction.

Terminals 308 extend between the outer housing 301 and the inner housing 302. Each terminal 308 is fixed to the outer housing 301 so one end thereof projects exterior of the outer housing 301, and is fixed to the inner housing 302 so that the other end projects into the interior of the inner housing 302. A terminal intermediate portion 309 is formed in a wave-like manner, and elastic deformation of this intermediate portion 309 allows the inner housing 302 to move relative to the outer housing 301. In this manner, the inner housing 302 "floats" in relation to the outer housing 301.

However, in the such a conventional floating-style connector, since the intermediate portion 309 of the terminal 308 is bent merely in a wavy form, the length of the elastically deformable portion may be insufficient and the terminal 308 fails to exhibit high flexibility. Also, since the trough portion of the wavy form abuts a lower corner portion of the inner housing 302, (shown at the end of the arrow in the lower right corner of FIG. 9) the extent of elastic deformation of the terminal 308 is restricted accordingly. As a result, the flexibility of the terminal 308 drops. When many of these type terminals 308 are used in the connector, the inner housing 302 fails to flexibly move relative to the outer housing 301 so that deviation between the circuit boards cannot be fully absorbed.

Since movement in the Z-axis direction is restricted by means of the stopper pieces 304 of the inner housing 302 and the upper pieces 305 of the outer housing 301, upon subjection to a strong force in the Z-axis direction at the time of removal of a counterpart connector, there is risk of the upper pieces 305 of the outer housing 301 being deformed.

The present invention is directed to a floating-style connector that overcomes the aforementioned disadvantages.

SUMMARY OF THE INVENTION

It is therefore a general object of the present invention to provide an improved floating-style connector having and inner housing encompassed by an outer housing, the inner housing being movable relative to the outer housing in the X, Y and Z directions.

Another object of the present invention is to provide a floating-style connector which has terminals with straight portions extending in parallel with a circuit board, the straight portions connecting the attachment portions of the terminals together, and the inner housing of the connector being raised with respect to the outer housing so as to define a space between the lower surface of the inner connector housing and the upper surfaces of the terminal straight portions so that the inner housing is movable relative to the outer housing, the upward movement of the inner housing being limited by a series of stops supported by the outer connector housing.

A still further object of the present invention is to provide a floating-style connector of the receptacle construction wherein a connector inner housing is held within a central opening of a connector outer housing, the inner and outer housings being interconnected by terminals that extend through the two housings, the terminals including vertical loop portions interposed between contact and tail portions of the terminals and wide horizontal straight portions interposed between the vertical loop portions and the contact portions to provide a larger range of movement of the inner connector housing with respect to the outer connector housing.

Yet an additional object of the present invention is to provide a floating-style connector of the type having an inner connector housing that is flexibly connected to an encompassing outer connector housing by a plurality of conductive terminals, the inner connector housing being capable of movement in the X, Y and Z direction, the outer connector housing including a plurality of fitting nails for mounting the outer connector housing to a circuit board, the fitting nails including stop members that project toward and above the inner connector housing and serve to provide stop surfaces therefor that limit movement of the inner connector housing in the Z direction.

In order to achieve the above objects, a floating-style connector in accordance with the principles of the present invention is provided with an insulative outer housing having two spaced-apart longitudinal side walls and an open recess defined in the space between the side walls. An insulative inner connector housing is accommodated within the recess and is movable relative to the outer housing. A plurality of elastically deformable, conductive terminals connect the two housings together. Each terminal includes a tail portion for connecting to a circuit board, a contact portion to contact a terminal of a counterpart, mating connector. The terminals have body portions that extend between their respective contact and tail portions.

The body portions of each terminal further includes a first attachment portion attached to the outer connector housing, a second attachment portion attached to the inner connector housing, and a freely deformable portion having a general "L" shape between the first and the second attachment portions. This freely deformable portion includes a horizontally straight portion extending horizontally and a vertically straight portion extending vertically and connecting, preferably at an angle of about 90 degrees, with the horizontally straight portion. The first attachment portion and the vertically straight portion may be considered as forming a vertical loop.

Preferably, the inner connector housing includes a center wall and an engagement wall, the center wall extending vertically and parallel to the side walls of the outer connector. The terminal second attachment portions are attached to a lower end of the inner housing.

In another embodiment of a floating-style connector constructed in accordance with the principles of the present invention, the outer housing includes side walls that define a center open area that receives an inner housing which is movable in relation to the outer housing, and a plurality of elastically deformable terminals with tail portions for connecting to a circuit board, and a contact portions for mating with counterpart terminals of a counterpart connector. The terminals are attached to the outer and inner housings and serve to physically connect the two housings together. The outer housing further includes restricting thick walls formed at opposing ends, and two restricting end walls that connect to the restricting thick-walls. These end walls are located opposite each other at each opposing ends of the outer housing. The inner housing includes end walls formed at longitudinally opposing ends thereof and the end walls face the restricting end walls, and the fitting nails are attached to the restricting thick-walls. These fitting nails include respective stop portions extending above the end walls.

Each of the fitting nails preferably includes a vertical body portion attached to the outer connector restricting thick-wall, an attachment portion connected to the lower end of the outer housing and to the circuit board, and stop portion connected to an upper end of the body portion which extends horizontally out over a portion of the inner connector housing.

The outer and inner housings may be formed integrally with each other such that the restricting end wall portions and the corresponding to-be-restricted end wall portions are connected together by means of respective connection portions. Subsequently, the connection portions are removed so as to separate the outer housing and the inner housing from each other.

According to the floating-type connector of the present invention, each terminal includes a straight portion extending parallel to the circuit board to which the connector is mounted. This straight portion is horizontal and forms part of the freely (unrestricted) deformable portion of each terminal that connects the outer and inner housings together. Also, a space is provided between a lower surface of the inner housing and the upper surfaces of these terminal straight portions. Thus, the terminals exhibit high flexibility, so that the inner housing is movable relative to the outer housing. The fitting nails reliably resist upward forces applied to the inner housing during detachment of the connector assembly, thereby preventing deformation of the outer housing and terminals, as well as detachment of the terminal tail portions from the circuit board, thereby increasing the reliability of the connector.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 6 is a perspective view, partially in section of the receptacle connector of FIG. 2, taken along line B-B of FIG. 2 to illustrate the metal fitting nail in place within the receptacle connector;

FIG. 7 is a perspective view of a portion of the bottom surface of the receptacle connector of FIG. 2;

DESCRIPTION OF THE PREFERRED EMBODIMENTS

Figure 1:
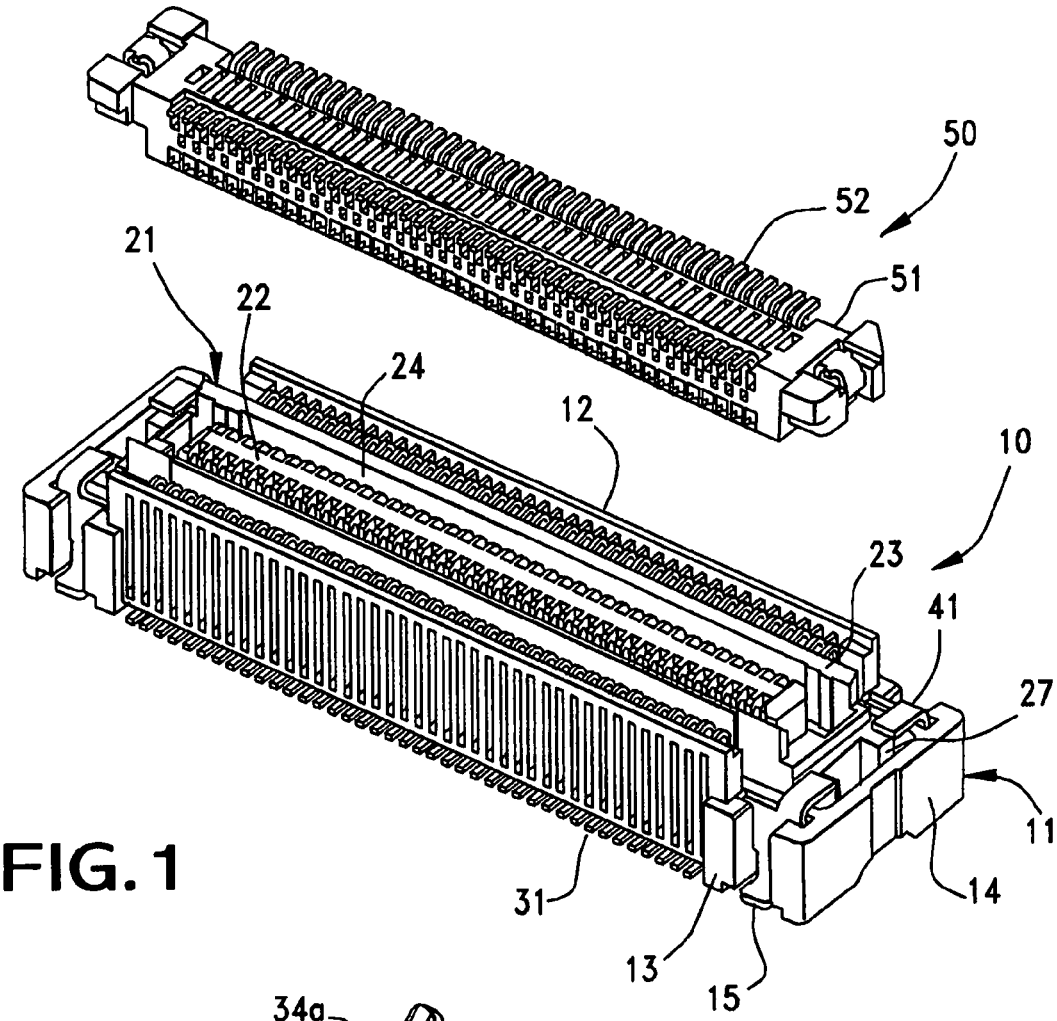
FIG. 1 is a perspective view showing a connector assembly with two connector halves which combined form a board to board connector assembly in accordance with the principles of the present invention.

FIG. 1 is a perspective view of a floating-style connector assembly which utilizes a floating-type receptacle connector 10 constructed in accordance with the principles of the present embodiment. The connector 10 is a surface mount connector which is mounted on the surface of a circuit board. A counterpart connector 50 which mates with the floating connector 10 is also a surface mount connector that is mounted on the surface of another circuit board. The connector 10 of the present embodiment and the counterpart connector 50 are mated together to form the connector assembly and electrically connect the two circuit boards together. In the present embodiment, terms for expressing direction, such as up, down, left, right, front, and rear, are used for explaining the structure and action of respective portions of the connector 10. However, these terms represent respective directions for the case where the connector 10 is used in an orientation shown in the drawings, and must be construed to represent corresponding different directions when the orientation of the connector 10 is changed.

Figure 2:
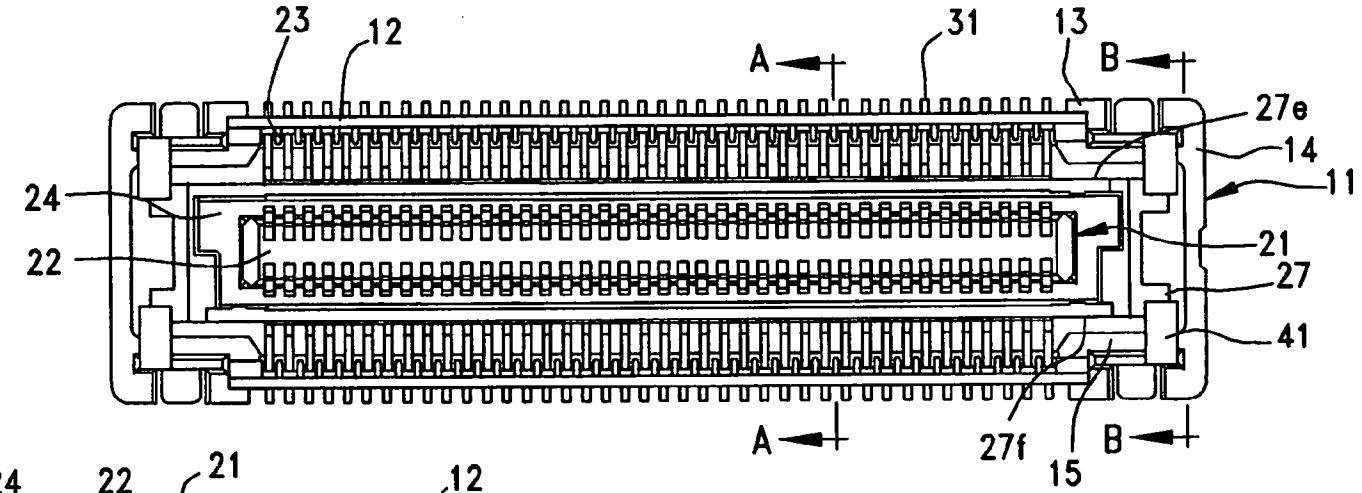
FIG. 2 is a plan view of the bottom half (or receptacle) connector of the connector assembly of FIG. 1.

As shown in FIG. 2, the connector 10 includes an outer housing 11 and an inner housing 21 which are both formed of an electrically insulative material, such as a synthetic resin. The outer and inner housing 11, 21 are mutually independent and separate members. However, when the outer housing 11 and the inner housing 21 are formed by a molding process, such as by injection molding, they may be formed together and subsequently separated from each other by conventional means. The outer housing 11 is shown as a rectangular member that includes two longitudinal and generally parallel side walls 12 that are spaced apart from each other.

There are thick-walls 13 formed at opposite ends of each of the side walls 12 and restricting end walls 14 in parallel with each other, extending in the lateral direction of the connector 10 (in the vertical direction in FIG. 2), and integral with the restricting thick-walls 13 which face the respective restricting end walls 14. Opposite ends of each of the restricting end walls 14 are preferably formed integrally with corresponding ends of the restricting thick-walls 13. The central recess of the outer connector housing 11 is therefore cooperatively defined by the side walls 12, the restricting thick-walls 13, and the restricting end walls 14.

The inner housing 21 is also shown as a rectangular member that includes a longitudinal center wall 22, two engagement walls 23 that extend longitudinally on opposite sides of the center wall 22, two engagement groove portions 24 extending longitudinally between the center wall 22 and a corresponding engagement wall portion 23 and, two to-be-restricted end wall portions 27 integral with respective longitudinally opposite ends of the center wall portion 22 and engagement wall portions 23. In FIG. 2, 27*e* and 27*f* denote opposite side surfaces of the to-be-restricted end wall portions 27. The external size of the inner housing 21 is smaller than the internal size of the outer housing 11, and the inner housing 21 is accommodated in the accommodation recess portion of the outer housing 11.

The connector 10 has a plurality of conductive terminals 31 that are arranged in a predetermined spacing in two rows extending lengthwise of the connector 10. They are attached to the connector 10 so as to connect together and extend between the outer and inner housings s11, 21. The terminals 31 are attached to the side walls 12 of the outer housing 11 and to the center wall 22 of the inner housing 21, thereby physically connecting the outer housing 11 and the inner housing 21 together. The connector 10 is a floating-type connector; i.e., where the outer housing 11 and the inner housing 21 are not fixed together, but rather are connected together by the terminals 31. The terminals 31 are elastic and deformable, so that the inner housing 21 is connected to the outer housing 11 in a movable, or floating condition.

The outer housing 11 is surface mounted to a circuit board (not shown). The connection is accomplished by way of the terminal tail portions and the metal fitting nails 41. The fitting nails 41 are attached to attachment portions 15 formed on the restricting thick-wall portions 13.

The mating connector 50 (FIG. 1) includes a counterpart connector housing 51 formed of an insulative material which supports a plurality of conductive counterpart terminals 52. The mating connector housing 51 is also rectangular and includes projection portions that are inserted into the corresponding engagement groove portions 24 of the inner housing 21 are formed on the lower surface in FIG. 1 of the counterpart housing 51, and the counterpart terminals 52 are partially exposed from the lower surface. Also, the counterpart terminals 52 are partially exposed from the upper surface in FIG. 1 of the counterpart housing 51, and the exposed portions are connected, by soldering or the like, to corresponding connection pads connected to corresponding electrically conductive traces on an unillustrated another circuit board.

As shown in FIG. 1, while the engagement surface (upper surface in FIG. 1) of the connector 10 and the engagement surface (lower surface in FIG. 1) of the counterpart connector 50 face each other, the connector 10 and/or the counterpart connector 50 are moved toward each other so as to engage the connector 10 and the counterpart connector 50 together. By this procedure, the terminals 31 of the connector 10 come into contact with the corresponding counterpart terminals 52 of the mating connector 50, thereby establishing electrical connection therebetween. As a result, the paired circuit boards on which the connector 10 and the mating connector 50 are mounted respectively are electrically connected together.

Figure 3:
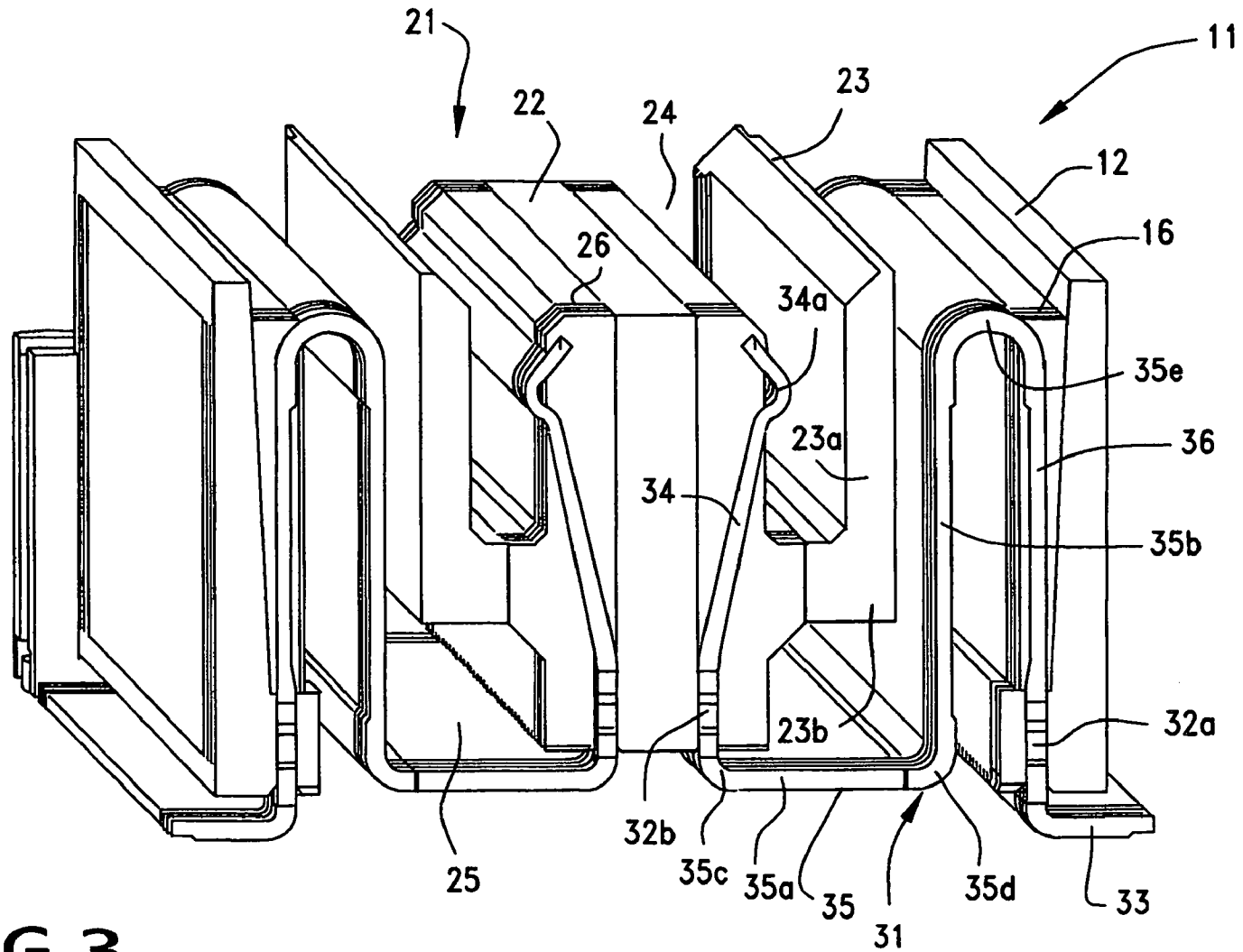
FIG. 3 is a sectional view of the connector of FIG. 2, taken along line A-A thereof.

As shown in FIG. 3, a plurality of vertical first terminal accommodation grooves 16 are formed in the side walls 12 of the outer housing 11 at predetermined pitch spacings in a longitudinal row of the connector 10. A plurality of vertical second terminal accommodation grooves 26 are formed in the side walls of the center wall 22 of the inner housing 21 at predetermined pitch spacings in a longitudinal row of the connector 10. Each terminal 31 is accommodated in a single set of first and second terminal accommodation grooves 16, 26. Some terminals 31 may be eliminated as appropriate in accordance with the terminal array of mating connector 50.

In FIG. 3, for convenience of illustration, only some of the first terminal accommodation grooves 16, second terminal accommodation grooves 26, and terminals 31 are illustrated, and illustration of the first terminal accommodation grooves 16, second terminal accommodation grooves 26, and terminals 31 present in intermediate regions of the rows extending in the longitudinal direction of the connector 10 is omitted.

The inner housing engagement walls 23 are shown to have a generally L-shaped section disposed on the opposite side wall surfaces of the center wall 22. Each of the engagement wall 23 is seen to include a vertical portion 23*a* and a horizontal portion 23*b*. The engagement groove portion 24 is formed between the center wall 22 and the vertical portion 23*a* of each engagement wall 23. The projections, including the terminals 52, of the mating connector 50 are inserted into the engagement grooves 24. The upper surface of each of the horizontal portion 23*b* serves as a bottom surface for each engagement groove 24. The second terminal accommodation grooves 26 are formed in the center wall 22 along its length while extending through portions of the center wall 22 where the horizontal portions 23*b* merge into the side wall surfaces of the center wall 22.

Figure 4:
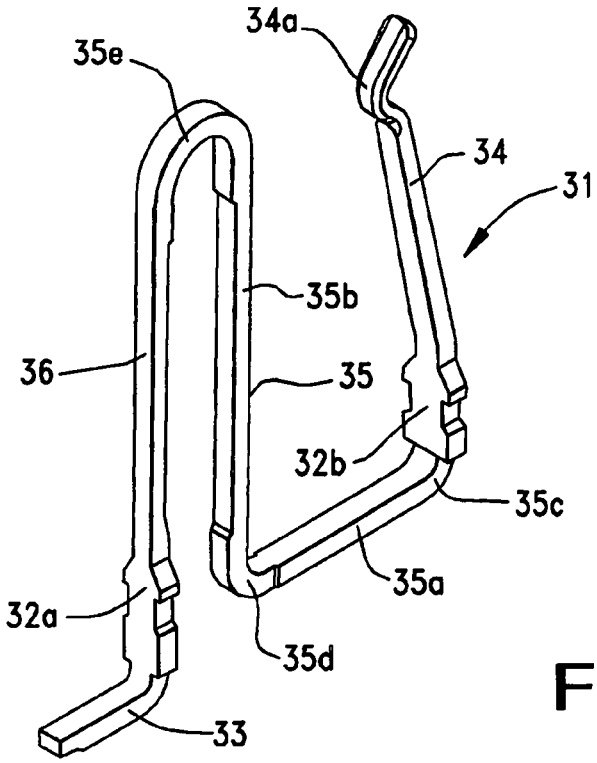
FIG. 4 is a perspective view of a terminal used in the receptacle connector of FIG. 2.
Figure 9:
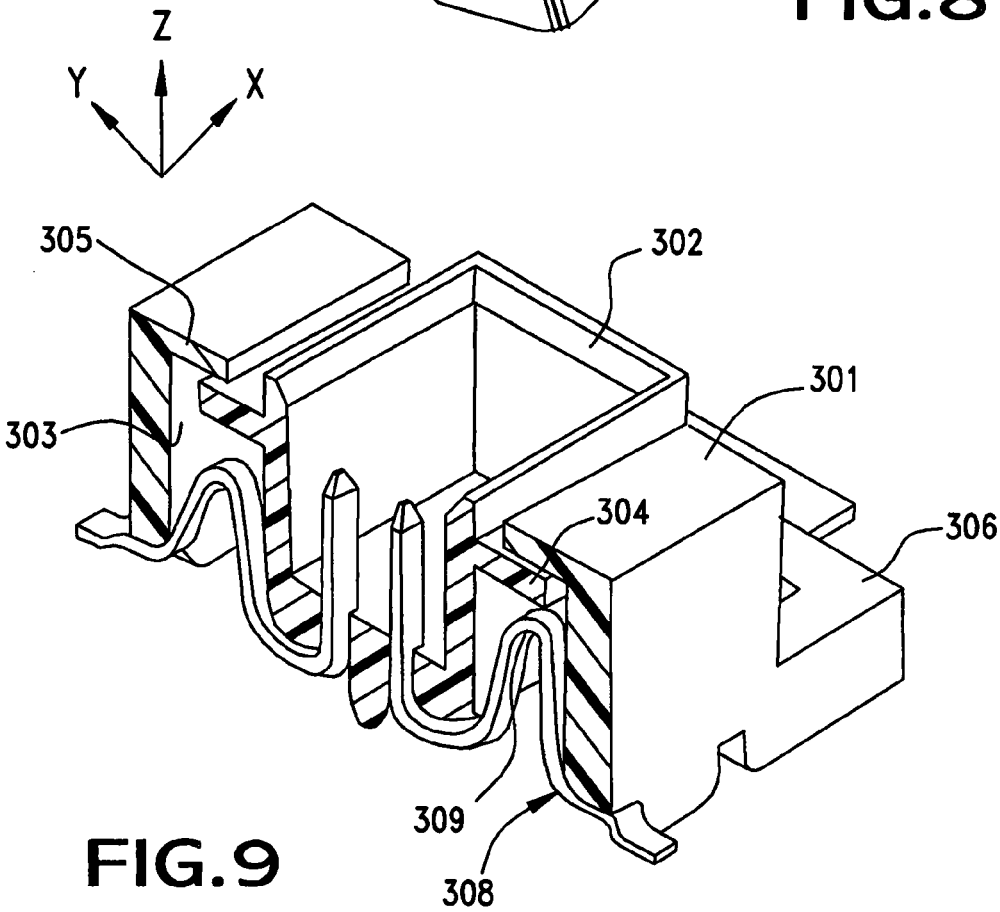
FIG.9 (PRIOR ART)

As shown in FIG. 4, each of the terminals 31 is formed into a particular shape by bending a metal strip to have a side-view shape resembling the letter S. The terminal 31 includes a first attachment portion 32*a* attached to the outer housing 11, a second attachment portion 32*b* attached to the inner housing 21, a tail portion 33 for contact to circuit board, a contact arm portion 34 that contacts corresponding terminals 52 of the mating connector 50, a freely deformable portion 35 which is freely deformable between the first and second attachment portions 32*a*, 32*b*, and a selectively restricted deformable portion 36 extending between the first attachment portion 32*a* and the freely deformable portion 35. By "freely deformable", is meant that the movement (deformation) of the terminal in this area is not restricted as it is in the prior art connector of FIG. 9.

Projections and dents are formed on the side surfaces of the first and second attachment portions 32*a* and 32*b*. The projections of the first attachment portion 32*a* skive into the side walls of the first accommodation groove 16 of the outer housing 11, and the projections of the second attachment portion 32*b* bite into the side walls of the second terminal accommodation groove 26 of the inner housing 21, whereby the first and second attachment portions 32*a* and 32*b* are fixed to the outer and inner housings 11 and 21, respectively. As shown in FIG. 3, the first attachment portion 32*a* is attached to near the bottom of the first terminal accommodation groove 16 of the outer housing 11, and the second attachment portion 32*b* is attached to near the bottom of the second terminal accommodation groove 26.

The tail portion 33 extends laterally out from the bottom of the first attachment portion 32*a* exterior of the side walls 12 of the outer housing 11. As shown in FIG. 3, the lower end of the first attachment portion 32*a* slightly projects downward beyond the lower surfaces of the side walls 12 of the outer housing 11. The tail portion 33 is connected, by soldering or the like, to a pad of the circuit board.

The contact arm portion 34 is a cantilevered arm projecting obliquely upward from the upper end of the second attachment portion 32*b* and has a contact projection 34*a* which is formed on a free end thereof. The contact projection

34*a* is formed to project toward the selectively restricted deformable portion 36. As shown in FIG. 3, most of the contact arm portion 34 is received within the second terminal accommodation groove 26 of the inner housing 21, and the contact projection 34*a* projects into the engagement groove portion 24 from the second terminal accommodation groove 26. When the terminals 52, of the mating connector 50 are inserted into the engagement groove portions 24, the spring function of the contact arm portions 34 presses the contact projections 34*a* against the terminals 52, thereby electrically connecting the terminals 31 and the counterpart terminals 52 together.

The contact arm portions 34 are accommodated in the corresponding second terminal accommodation grooves 26; accordingly, the contact arm portions 34 are movable in the span direction of the terminals 31 (the connector lateral direction), but are not movable in the pitch direction of the terminals 31 (the connector longitudinal direction). Thus, the contact projections 34*a* are placed with respect to the pitch direction of the terminals 31 and in accurate contact with and electrically connected to the counterpart terminals 52.

The freely deformable portion 35 has a side-view shape resembling the letter L and includes a horizontal straight portion 35*a*, a vertical straight portion 35*b*, a first bend portion 35*c* bent at about 90 degrees and integral with one end of the horizontal straight portion 35*a* and with the lower end of the second attachment portion 32*b*, a second bend portion 35*d* bent at about 90 degrees and integral with the other end of the horizontal straight portion 35*a* and with the lower end of the vertical straight portion 35*b*, and a curved portion 35*e* curved at about 180 degrees and joining the upper end of the vertical straight portion 35*b* with the upper end of the selectively restricted deformable portion 36.

In this manner, the freely deformable portion 35 has a side-view shape resembling the letter L and is configured such that the second bend portion 35*d* is bent at about 90 degrees to the horizontal straight portion 35*a* and with the vertical straight portion 35*b* so that the portion is free from restriction by the outer or inner housing 11, 21. In this manner, the freely deformable portion, assumes a long length between the first and second attachment portions 32*a*, 32*b* and is flexibly deformable so that the inner housing 21 flexibly moves relative to the outer housing 11. In this case, the inner housing 21 is movable laterally, longitudinally and vertically relative to the outer housing 11. It can also tilt from side to side.

If the freely deformable portion 35 has such a side-view shape as to be gently curved and to extend between the first bend portion 35*c* and the curved portion 35*e*, the length of the freely, elastically deformable portion will become short. As a result, the flexibility of the freely deformable portion 35 deteriorates, and thus the inner housing 21 fails to be flexibly movable in relation to the outer housing 11. Particularly, in the case where the number of the terminals 31 is large (about 100), even when a difference in flexibility is small between different terminal shapes on the individual terminal basis of the terminals 31, the small difference in flexibility greatly influences the flexibility of movement of the inner housing 21 in relation to the outer housing 11, since the inner housing 21 is supported by means of all the terminals 31. In the present embodiment, the freely deformable portion 35 has a side-view shape resembling the letter L, and the horizontally straight portion 35*a* and the vertically straight portion 35*b* are integral with each other via the second bend portion 35*d* which is bent at about 90 degrees. Thus, the flexibility of movement of the inner housing 21 in relation to outer housing 11 can be improved greatly.

Also, since the freely deformable portion 35 has a side-view shape resembling the letter L, and the horizontal straight portion 35*a* and the vertical straight portion 35*b* are integral with each other via the second bend portion 35*d* which is bent at about 90 degrees (FIG. 3), a space 25 is defined by the horizontal portion 23*b* of each of the engagement walls 23, the center wall 22, the horizontal straight portions 35*a*, and the vertical straight portions 35*b*. In other words, a lower corner portion of the inner housing 21 and the freely deformable portions 35 define a rectangular space 25. Accordingly, even when the inner housing 21 is moved or tilted in relation to the outer housing 11 in the span direction of the terminals 31, the inner housing 21 and the freely deformable portions 35 do not interfere with each other. Thus, the freely deformable portions 35 can be flexibly deformed without any restriction, and the inner housing 21 can flexibly move in relation to the outer housing 11. Also, the freely deformable portions 35 are free from damage.

The selectively restricted deformable portions 36 are received in the first terminal accommodation grooves 16, and accordingly, the selectively restricted deformable portions 36 are movable in the lateral direction of the connector 10, but are not movable in the longitudinal direction of the connector 10. Accordingly, the freely deformable portions 35 are also restricted to a certain extent in movement in the pitch direction of the terminals 31, whereby the distance between adjacent freely deformable portions 35 is maintained, and the adjacent freely deformable portions 35 do not contact with each other which would result in an unwanted shorting of the connector terminals.

Next, the structure for restricting movement of the inner housing 21 relative to the outer housing 11 will be described. The outer and inner housings 11, 21 are connected together by means of the elastic terminals 31, the inner housing 21 moves relative to the outer housing 11. Movement of the inner housing 21 is restricted at longitudinally opposite end portions of the connector 10.

In this case, the to-be-restricted end walls 27 have a substantially rectangular block shapes and are preferably integral with the end portions of the center wall 22 and engagement walls 23. Projections 27*b* and 27*c* are formed in the outer regions of each of the to-be-restricted end walls 27 to form therebetween a recess 27*a* located at the center of and extending vertically through the to-be-restricted end wall 27. A downward projection 27*d* is formed on the lower surface of each of the to-be-restricted end walls 27.

The movement of the inner housing 21 relative to the outer housing 11 in the longitudinal direction of the connector 10, is restricted by a portion of the end surface of each of the to-be-restricted end walls 27 of the inner housing 21, and in the present embodiment, the longitudinal end surfaces of the projections 27*b* and 27*c* abut the inner wall surface of the corresponding restricting end wall 14 of the outer housing 11. The movement of the inner housing 21 in the lateral direction of the connector 10, is restricted by the side surfaces 27*e*, 27*f* of the to-be-restricted end wall 27, abuttin the inner wall surfaces of the restricting thick-wall 13 of the outer housing 11.

Movement toward the circuit board (vertical) of the inner housing 21 is restricted by the lower surfaces of the downward projections 27*d*, abutting the upper surfaces of the circuit board. Movement (upward) toward the mating connector 50 is restricted by a portion of the upper surfaces of the to-be-restricted end walls 27 abutting the fitting nails 41 attached to the restricting thick-walls 13 of the outer housing 11. A tilting movement, in the span direction of the terminals 31, of the inner housing 21 in relation to the outer housing 11 is restricted as follows: at least a portion of the lower surface of each of the to-be-restricted end wall portions 27 of the inner housing 21 abuts the upper surface of the circuit board, and at least a portion of the upper surface of each of the to-be-restricted end wall portions 27 abuts the fitting nails 41.

Figure 5:
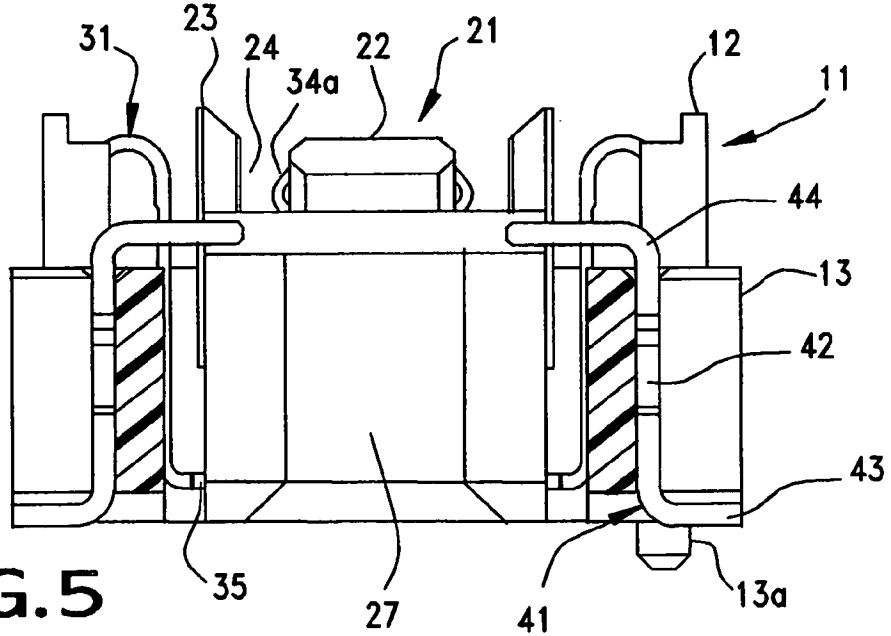
FIG. 5 is a cross-sectional view of an end portion of the receptacle connector of FIG. 2 and taken along line B-B thereof.

As shown in FIGS. 5 and 7, a downward projection 13*a* is formed on the lower surface of the restricting thick-wall 13. The projection 13*a* is inserted into a positioning hole or the like formed on a circuit board, thereby positioning the outer housing 11 in relation to the circuit board. The number, position, and the like of the projections 13*a* may be determined as appropriate. The projection 13*a* may be eliminated as appropriate.

Figure 8:
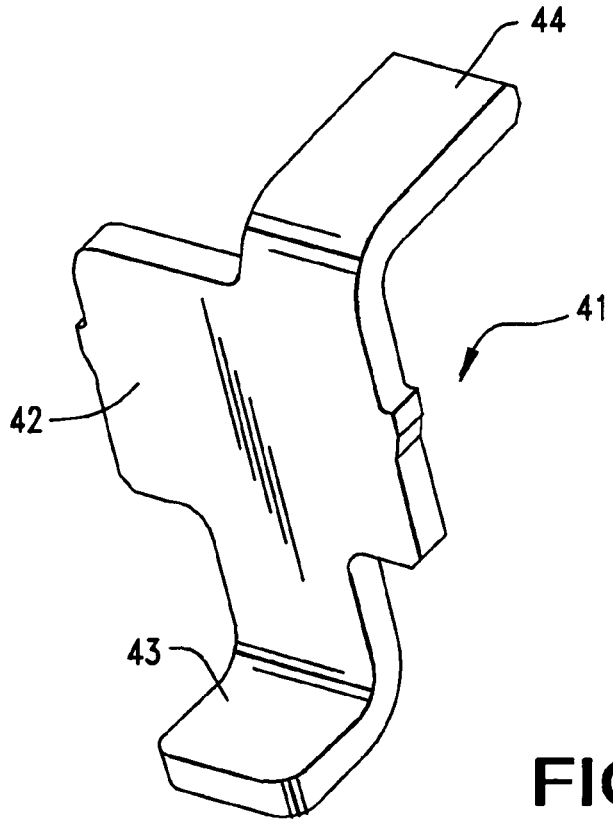
FIG. 8 is a perspective view of a fitting nail used in the receptacle connector of FIG. 2; and, FIG. 9 is a sectional, perspective view of a conventional floating-type connector.

As shown in FIG. 8, each of the fitting nails 41 is a member formed by bending a thick-walled metal strip having high strength and has a longitudinal, sectional shape resembling a crank. The fitting nails 41 includes a body portion 42 to be attached to the restricting thick-wall portion 13 of the outer housing 11; an attachment portion 43 to be attached, by soldering or the like, to a connection pad on a circuit board; and a stop portion 44 which extends above the to-be-restricted end wall portion 27 of the inner housing 21.

The body portion 42 has projections and dents formed on side surfaces. The projections bite into the side walls of the groove-like metal-member attachment portion 15 formed on the corresponding restricting thick-wall portion 13 of the outer housing 11, whereby the body portion 42 is fixedly attached to the restricting thick-wall portion 13. The attachment portion 43 extends laterally from the lower end of the body portion 42 toward the exterior of the outer housing 11. The lower surface of the attachment portion 43 is attached, by soldering or the like, to a corresponding connection pad on the circuit board. The stop portion 44 extends laterally from the upper end of the body portion 42 toward the interior of the outer housing 11 and reaches a region above the corresponding to-be-restricted end wall 27 of the inner housing 21.

In other words, the stop portion 44 overlaps a region above at least a portion of the upper surface of the corresponding to-be-restricted end wall portion 27; in the present embodiment, a region above the upper surface of each of the projections 27*b* and 27*c* and not extending above the recess 27*a*. In this case, as shown in FIGS. 5 and 6, since the stop portions 44 located at the laterally opposite sides of the connector 10 overlap at least a portion of the upper surface of the corresponding to-be-restricted end wall portion 27, the to-be-restricted end wall portion 27 does not move upward through the space between the opposed stopper portions 44. In a state shown in FIGS. 5 and 6, a gap exists between the lower surfaces of the stopper portions 44 and the upper wall surface of the to-be-restricted end wall 27.

When the inner housing 21 moves upward in relation to the outer housing 11, a portion of the upper surface of each of the to-be-restricted end walls 27 of the inner housing 21; for example, in FIG. 5, left and right end portions of the to-be-restricted end wall portion 27 abut the lower surfaces of the stop portions 44, thereby preventing further upward movement of the inner housing 21. In this case, since the fitting nails 41 are of high strength, the stopper portions 44 are hardly deformed and reliably restrict an upward movement of the inner housing 21. In the case where an upward movement of the inner housing 21 is associated with, for example, an operator's attempt to remove the counterpart connector 50, a strong force is applied to the stopper portions 44. However, since the stop portions 44 are hardly deformed, the stop portions 44 reliably restrict the upward movement of the inner housing 21.

The body portion 42 of each of the fitting nails 41 is attached to the corresponding restricting thick-wall 13, which is thicker than the side wall 12 and has high strength. Thus, even when a strong force is applied to the stop portions 44, the restricting thick-walls 13 to which the fitting nails 41 are attached are not deformed; therefore, the stop portions 44 reliably restrict an upward movement of the inner housing 21. Furthermore, since the attachment portions 43 are attached, by soldering or the like, to corresponding connection pads on a circuit board, even when a strong force is applied to the stop portions 44, the fitting nails 41 are not detached from the circuit board, and the stop portions 44 reliably restrict upward movement of the inner housing 21.

In the case where the inner housing 21 is tilted in the span direction of the terminals 31 in relation to the outer housing 11, a portion of the upper surface of each of the to-be-restricted end walls 27 of the inner housing 21; for example, in FIG. 5, a left or right end portion of the to-be-restricted end wall 27 abuts the lower surface of the stop portion 44, thereby preventing a further tilting movement of the inner housing 21.

Since the fitting nails 41 are attached to the corresponding opposite restricting thick-wall portions 13, when an external force directed in the span direction of the terminals 31 is applied to the connector 10, the fitting nails 41 prevent detachment of the tail portions 33 of the terminals 31 from corresponding connection pads connected to corresponding electrically conductive traces of a circuit board. Usually, the point of application of an external force which is applied to the connector 10 in the span direction of the terminals 31 is located above the surface of the circuit board.

Thus, the external force generates such a rotation moment as to tilt the connector 10 in the span direction of the terminals 31. The rotation moment generates such an upward force as to lift the side wall 12 corresponding to the side subjected to the external force; i.e., such a force as to move the side wall 12 away from the circuit board. Thus, the tails 33 of the terminals 31 fixed to the side wall 12 corresponding to the side subjected to the external force are subjected to a force which is directed in such a direction as to detach the tail portions 33 from the corresponding connection pads connected to the corresponding electrically conductive traces of the circuit board.

However, as shown in FIG. 7, in the present embodiment, the attachment portion 43 of each of the fitting nails 41 is located on an extension line of a row of the terminal tails 33. Thus, as in the case of the tail portions 33 of the terminals 31, the attachment portions 43 of the fitting nails 41 attached to the restricting thick-walls 13 formed at opposite ends of the side wall 12 corresponding to the side subjected to the external force are also subjected to the force which is directed in such a direction as to make detachment from the circuit board.

Accordingly, the attachment portions 43 of the fitting nails 41 bear a considerable portion of the force directed in such a direction as to make detachment from the circuit board, thereby reducing a force applied to the terminal tails and thus preventing detachment of the tails 33 from the pads of the circuit board.

If the fitting nails 41 are not attached to the restricting thick-walls 13 formed at opposite ends of the side walls 12, but are attached to central portions of the restricting end walls 14, the attachment portions 43 are located away from the terminal tails 33 in terms of distance along the span direction of the terminals 31. As a result, the attachment portions 43 fail to sufficiently function to bear the force directed in such a direction as to make detachment from the circuit board. Accordingly, a force applied to the terminal tails 33 is not reduced, and thus the terminal tails 33 may be detached from the pads of the circuit board.

In the present embodiment, since the fitting nails 41 are attached to the restricting thick-walls 13 located at opposite ends of the outer housing 11 and at opposite sides of the to-be-restricted end walls 27 of the inner housing 21, the manufacture of the connector 10 is facilitated. As mentioned previously, when the outer and inner housings 11, 21 are formed by a molding process, such as injection molding, they may be integrally formed in the same mold. In this case, the connector 10 is in such a state that all of the terminals 31 and the fitting nails 41 are removed from the connector 10 shown in FIG. 1 or 2. Furthermore, connection portions may be provided that connect the outer and inner housings 11, 21 together and these would extend between the to-be-restricted end walls 27 of the inner housing 21 and the restricting end walls 14 of the outer housing 11. More specifically, rod-like connection portions extend between central portions of the to-be-restricted end walls 27 and central portions of the restricting end walls 14. The connection portions maintain the outer housing 11 and the inner housing 21 in the positional relation shown in FIG. 1 or 2.

In a state that the connection portions are present, the terminals 31 are attached to the outer housing 11 and to the inner housing 21, and the fitting nails 41 are attached to the outer housing 11. In this case, since the connection portions maintain the positional relation between the outer housing 11 and the inner housing 21, the step of attaching the terminals 31 to both of the outer housing 11 and the inner housing 21 can particularly be facilitated.

After completion of attachment of the terminals 31 and the connector-attaching auxiliary metal members 41, the connection portions are preferably cut off. In this case, since the fitting nails 41 are attached to the corresponding restricting thick-walls 13 located at opposite sides of each of the to-be-restricted end walls 27 to thereby leave a space between the stop portions 44 of the fitting nails 41 as shown in FIGS. 5 and 6, the connection portions which connect central portions of the to-be-restricted end walls 27 and central portions of the restricting end walls 14 respectively together can be readily cut off. Accordingly, the manufacture of the connector 10 can be facilitated.

If the fitting nails 41 are not attached to each of the restricting thick-walls 13, but are attached to a central portion of each of the restricting end walls 14, the stop portion 44 is located above each of the connection portions. This disables the cutting off of the connection portions until after the fitting nails 41 are attached. In order to cope with this problem, in the course of manufacture of the connector 10, in a state that the connection portions are present, the terminals 31 are attached, and after completion of attachment of the terminals 31, the connection portions are cut off. After completion of cutting-off of the connection portions, the fitting nails 41 are attached. In this case, the same processing apparatus can be used for attaching the fitting nails 41 and attaching the terminals 31. However, the same processing apparatus cannot be used for cutting off the connection portions and attaching the terminals 31.

Thus, after completion of attachment of the terminals 31, setups are changed; furthermore, after completion of cutting-off of the connection portions, setups are again changed. As a result, the frequency of setup increases, causing an increase in man-hours required for manufacturing the connector 10. By contrast, according to the present embodiment, after completion of attachment of the terminals 31 and the fitting nails 41, the connection portions are cut off. Thus, changing setups is performed only once, thereby reducing man-hours required for manufacturing the connector 10; i.e., facilitating the manufacture of the connector 10.

Since the fitting nails 41 are attached to the corresponding restricting thick-wall 13 located at opposite ends of the outer housing 11 and at opposite sides of the to-be-restricted end walls 27 of the inner housing 21, the recess 27*a* can be formed on an end portion, with respect to the longitudinal direction of the connector 10, of each of the to-be-restricted end wall portions 27. As mentioned previously, a connection portion extending to the corresponding restricting end wall 14 is formed on the end portion, with respect to the longitudinal direction of the connector 10, of each of the to-be-restricted end walls 27. By means of providing the recess 27*a* and forming the connection portions in the corresponding recess 27*a*, space around the individual connection portions increases, thereby facilitating mold design for forming the connection portions, and facilitating cutting-off of the connection portions. The provision of the downward projections 27*d* also contributes to an increase in space around the individual connection portions, thereby yielding a similar effect. Notably, the recess 27*a* may be eliminated as needed.

As described above, in the present embodiment, each of the terminals 31 includes the first attachment portion 32*a* attached to the outer housing 11, the second attachment portion 32*b* attached to the inner housing 21, and the freely deformable portion 35 having a shape resembling the letter L and freely deformable between the first attachment portion 32*a* and the second attachment portion 32*b*. The freely deformable portion 35 includes the horizontal straight portion 35*a* and the vertical straight portion 35*b* extending at an angle of about 90 degrees to the horizontal straight portion 35*a*.

Thus, the freely deformable portion 35 has a long, freely, elastically deformable length and thus can be flexibly deformable. Therefore, the inner housing 21 can flexibly move in relation to the outer housing 11.

The center wall 22 and horizontal portion 23*b* of the inner housing 21 and the horizontal straight portions 35*a* and vertical straight portions 35*b* of the freely deformable portions 35 of the terminals 31 are disposed so as to define a rectangular space 25. Accordingly, even when the inner housing 21 is moved or tilted in relation to the outer housing 11 in the span direction of the terminals 31, the inner housing 21 and the freely deformable portions 35 do not interfere with each other. Thus, the freely deformable portions 35 can be flexibly deformed without any restriction, and the inner housing 21 can flexibly move in relation to the outer housing 11. Also, the freely deformable portions 35 are free from damage.

Furthermore, no particular limitation is imposed on the sectional shape of the space 25. For example, the center wall 22 and the horizontal portion 23*b* may be obliquely integral with each other to thereby form a space having a triangular section or may be arcuately integral with each other to thereby form a space having a quadrant section, so long as such a structural feature does not restrict the movement of the horizontal straight portions 35*a* and vertical straight portions 35*b*.

The outer housing 11 includes the restricting thick-walls 13 formed at opposite ends of the side wall portions 12, and two restricting end walls 14 each connecting with the restricting thick-walls 13 opposing each other at opposite ends of the outer housing 11; the inner housing 21 includes two to-be-restricted end walls 27 formed at longitudinally opposite ends, a longitudinal end surface of each of the to-be-restricted end walls 27 facing the corresponding restricting end wall 14, laterally opposite side surfaces of each of the to-be-restricted end walls 27 facing the corresponding restricting thick-walls 13; and the fitting nails 41 are attached to the corresponding restricting thick-walls 13, each of the fitting nails 41 including the stop portion 44, the stop portions 44 of the fitting nails 41 attached to the corresponding restricting thick-walls 13 located on laterally opposite sides of each of the to-be-restricted end walls 27, extending above the upper surface of the to-be-restricted end wall 27.

Accordingly, a horizontal movement of the inner housing 21 in relation to the outer housing 11 is restricted by means of the to-be-restricted end walls 27 abutting the restricting thick-walls 13 and the restricting end walls 14. A vertical movement of the inner housing 21 in relation to the outer housing 11 is restricted by means of the to-be-restricted end walls 27 abutting the stop portions 44 of the fitting nails 41.

In this case, the fitting nails 41 are attached to the corresponding restricting thick-walls 13 which are thick and have high strength. Thus, even when a strong force is applied to the stop portions 44, the restricting thick-walls 13 are not deformed; therefore, the stop portions 44 reliably restrict an upward movement of the inner housing 21. Furthermore, since the fitting nails 41 are attached, by soldering or the like, to pads on a circuit board, even when a strong force is applied to the stopper portions 44, the fitting nails 41 are not detached from the circuit board, and the stop portions 44 reliably restrict an upward movement of the inner housing 21.

The attachment portions 43 of the fitting nails 41 are attached to the circuit board in alignment with the terminal tail portions 33. Accordingly, when an external force directed in the span direction of the terminals 31 is applied to the connector 10, the tail portions 33 of the terminals 31 are prevented from being detached from their connection pads of the circuit board.

Furthermore, the outer housing 11 and the inner housing 21 are formed integral with each other such that the restricting end walls 14 and the to-be-restricted end walls 27 are connected together by means of respective connection portions; subsequently, the connection portions are removed so as to separate the outer housing 11 and the inner housing 21 from each other. Accordingly, the manufacture of the connector 10 can be facilitated.

The present invention is not limited to the above-described embodiment. Numerous modifications and variations of the present invention are possible in light of the spirit of the present invention, and they are not excluded from the scope of the present invention.

What is claimed is:

1. A floating-type connector comprising:

an outer housing, the outer housing including two spaced-apart side walls and an accommodation recess defined between the side walls;

an inner housing received in the accommodation recess and movable in relation to said outer housing;

a plurality of elastically deformable terminals, each of the terminals including a tail portion extending from said outer housing for contacting a circuit board and a contact portion supported by said inner housing for mating with a mating connector, said terminals being attached to said outer and inner housings, thereby connecting said outer and inner housings together, each of the terminals further including a first attachment portion that engages said outer housing, a second attachment portion that engages said inner housing, and a freely deformable portion extending between the first attachment and second attachment position, the freely deformable portion having a generally L-shaped configuration.

2. The floating-type connector according to claim 1, wherein said inner housing includes a center wall and an engagement wall, the center wall extending between said side walls, said terminal second attachment portions engaging lower ends of said inner housing center wall, the inner housing engagement wall including a horizontal portion connecting with a wall surface of said center wall portion at a vertically intermediate position, and a vertical portion connecting with the horizontal portion and extending vertically and in opposition to the wall surface of said center wall portion; and, said center wall and horizontal portion of said inner housing and said horizontal and vertical straight portions of said terminal freely deformable portions are disposed so as to define a space having a predetermined sectional shape.

3. The floating-type connector according to claim 2, wherein, each of said terminals further includes a selectively restricted deformable portion extending vertically, and a lower end of the selectively restricted deformable portion being connected to said first attachment portion, an upper end of the selectively restricted deformable portion being connected to an upper end of said freely deformable portion vertically straight portion; and said tail portions project underneath said outer housing side walls, said first attachment portions and said selectively restricted deformable portions are accommodated in corresponding first terminal accommodation grooves formed in said side wall portions; and, said second attachment portions and contact portions are accommodated in corresponding second terminal accommodation grooves formed in the center wall portion and extending vertically.

4. The floating-type connector according to claim 1, wherein said terminal freely deformable portions each include a horizontal straight portion and a vertical straight portion.

5. The floating-type connector according to claim 4, further including a space underneath said inner housing, and portions of said terminal proximate said second attachment portions extend into said space.

6. A floating connector comprising:

an outer housing including two longitudinal opposing side walls and a recess disposed between the side walls;

an inner housing disposed in the recess and movable relative to the outer housing; and, a plurality of conductive terminals, each terminal including a tail portion and a contact portion at opposite ends thereof, the terminals being attached to the outer and inner housings so as to physically connect said outer and the inner housings together, but permit relative movement between said inner and outer housings, and wherein said outer housing further includes restricting thick-walls formed at opposite ends of said side walls, and restricting end walls connected to said restricting thick-walls at opposite ends of said outer housing;

said inner housing includes to-be-restricted end walls formed at opposite ends thereof, a longitudinal end surface of each of the to-be-restricted end walls facing the corresponding restricting end wall, laterally opposite side surfaces of each of the to-be-restricted end walls facing the corresponding restricting thick-walls; and, a plurality of fitting nails attached to said restricting thick-walls, the fitting nails each including stop portions extending therefrom above said upper surfaces of said to-be-restricted end walls.

7. The floating-type connector according to claim 6, wherein each of said fitting nails includes a body portion extending vertically and attached to said restricting thick-wall, an attachment portion connecting with a lower end of said body portion for attaching to a circuit board, and said stop portion connecting with an upper end of said body portion and extending horizontally therefrom.

8. A floating-type connector according to claim 7, wherein said attachment portion is attached to the circuit board on an extension line of a longitudinal row of said terminal tail portions.

9. A floating-type connector according to claim 6, wherein said outer and inner housings are formed integrally with each other such that said restricting end walls and said to-be-restricted end walls are connected together by means of respective connection portions; subsequently, said being removed to separate said outer and inner housings from each other.

* * * * *